US011317494B2

(12) United States Patent
Lin et al.

(10) Patent No.: US 11,317,494 B2
(45) Date of Patent: Apr. 26, 2022

(54) LINEAR LUMINANCE ADJUSTING CIRCUIT

(71) Applicant: XIAMEN LEEDARSON LIGHTING CO., LTD, Fujian (CN)

(72) Inventors: Qiqiang Lin, Fujian (CN); Hemu Ye, Fujian (CN); Wei Liu, Fujian (CN)

(73) Assignee: XIAMEN LEEDARSON LIGHTING CO., LTD, Fujian (CN)

( * ) Notice: Subject to any disclaimer, the term of this patent is extended or adjusted under 35 U.S.C. 154(b) by 0 days.

(21) Appl. No.: 17/120,088

(22) Filed: Dec. 11, 2020

(65) Prior Publication Data

US 2021/0195708 A1 Jun. 24, 2021

(30) Foreign Application Priority Data

Dec. 20, 2019 (CN) ..... 201922318547.7

(51) Int. Cl.
*H05B 45/395* (2020.01)
*H05B 45/34* (2020.01)
*H05B 45/46* (2020.01)

(52) U.S. Cl.
CPC ..... *H05B 45/395* (2020.01); *H05B 45/34* (2020.01); *H05B 45/46* (2020.01)

(58) Field of Classification Search
CPC ..... H05B 45/395; H05B 45/34; H05B 45/46; H05B 45/20; H05B 45/345
See application file for complete search history.

(56) References Cited

U.S. PATENT DOCUMENTS 10,674,585 B1 * 6/2020 Liu ..... H05B 45/395
2015/0022103 A1 * 1/2015 Kao ..... H05B 45/38 315/192
2015/0312987 A1 * 10/2015 Gibbs ..... H05B 45/14 315/122

* cited by examiner

*Primary Examiner* — Daniel D Chang
(74) *Attorney, Agent, or Firm* — Chun-Ming Shih; Lanway IPR Services

(57) ABSTRACT

A linear luminance adjusting circuit includes a rectifying circuit, a constant voltage circuit, a control module, a linear constant current circuit and a hybrid luminance circuit. The rectifying circuit rectifies power from the AC power source to generated a rectified voltage. The constant voltage circuit transforms the rectified voltage into a constant voltage. The control module is electrically coupled to the constant voltage circuit. The control module generates a control signal using the constant voltage. The linear constant current circuit is electrically coupled to the rectifying circuit and the control module. The linear constant current circuit is powered up using the rectifying voltage. And the linear constant current circuit generates a linear current using the control signal. The hybrid luminance circuit is electrically coupled to the rectifying circuit and the linear constant current circuit. The hybrid luminance circuit illuminates using the linear current.

19 Claims, 3 Drawing Sheets

LINEAR LUMINANCE ADJUSTING CIRCUIT

FIELD

The present invention relates to a luminance adjusting circuit, and more particularly, to a linear luminance adjusting circuit.

BACKGROUND

A convention light emitting diode (LED) illuminating circuit has a complicated external circuitry in luminance and/or color adjustment. More specifically, the conventional LED illuminating circuit applies a two-stage structure that can be a combination of a constant-voltage stage and a constant-current stage or a combination of a constant-voltage stage and a linear stage. In this way, a rectified voltage is transformed into a linear direct-current (DC) voltage that can drive illuminating units. However, such two-stage structure takes large space and a high fabrication cost in the conventional LED illuminating circuit.

SUMMARY

The present disclosure aims at disclosing a linear luminance adjusting circuit that includes a rectifying circuit, a constant voltage circuit, a control module, a linear constant current circuit and a hybrid luminance circuit. The rectifying circuit has a first alternative-current (AC) input terminal that is electrically coupled to a positive terminal of an AC power source. Also, the rectifying circuit has a second AC input terminal that is electrically coupled to a negative terminal of the AC power source. In addition, the rectifying circuit rectifies power from the AC power source to generated a rectified voltage. The constant voltage circuit is electrically coupled to an output terminal of the rectifying circuit. Besides, the constant voltage circuit transforms the rectified voltage into a constant voltage. The control module is electrically coupled to the constant voltage circuit. And the control module generates a control signal using the constant voltage. The linear constant current circuit is electrically coupled to the rectifying circuit and the control module. Moreover, the linear constant current circuit is powered up using the rectifying voltage. And the linear constant current circuit generates a linear current using the control signal. The hybrid luminance circuit is electrically coupled to the rectifying circuit and the linear constant current circuit. Also, the hybrid luminance circuit illuminates using the linear current.

In one example, the rectifying circuit includes a full-bridge convertor and a first resistor. The full-bridge convertor is electrically coupled to the rectifying circuit's first AC input terminal and second AC input terminal for rectifying the power from the AC power source. The full-bridge convertor has a first direct-current (DC) output terminal electrically coupled to the constant voltage circuit. Also, the full-bridge convertor has a second DC output terminal electrically coupled to ground. The first resistor has a first terminal electrically coupled to the rectifying circuit's first AC input terminal. Besides, the first resistor has a second terminal electrically coupled to the rectifying circuit's second AC input terminal.

In one example, the first resistor includes a voltage-sensitive resistor.

In one example, the constant voltage circuit includes a constant voltage power supply chip that has an input terminal electrically coupled to the rectifying circuit for receiving the rectified voltage. Second, the constant voltage power supply chip has an output terminal electrically coupled to the control module for forwarding the control signal. Third, the constant voltage power supply chip has a current control terminal electrically coupled to ground. Fourth, the constant voltage power supply chip has an operating voltage electrically coupled to ground. Last, the constant voltage power supply chip has a ground terminal electrically coupled to ground. Also, the constant voltage power supply chip generates the constant voltage based on a predetermined voltage outputting hardware setting.

In one example, the constant voltage circuit also includes a second resistor that has a first terminal electrically coupled to the constant voltage power supply chip's current control terminal. Besides, the second resistor has a second terminal electrically coupled to ground.

In one example, the constant voltage circuit additionally includes a first capacitor that has a first terminal electrically coupled to the constant voltage power supply chip's operating voltage terminal. Moreover, the first capacitor has a second terminal electrically coupled to ground.

In one example, the constant voltage circuit includes a second capacitor that has a first terminal electrically coupled to the constant voltage power supply chip's output terminal. Besides, the second capacitor has a second terminal electrically coupled to ground.

In one example, the control module includes a wireless communication module.

In one example, the linear constant current circuit includes a linear driving chip that has a signal input terminal electrically coupled to the rectifying circuit for receiving the rectified voltage. Also, the linear driving chip has a constant current output terminal electrically coupled to the hybrid luminance circuit for forwarding the linear current.

In one example, the linear constant current circuit includes a third resistor that has a first terminal electrically coupled to the rectifying circuit. Moreover, the third resistor has a second terminal electrically coupled to the linear driving chip's signal input terminal.

In one example, the linear driving chip has a data input terminal electrically coupled to the control module for receiving the control signal. The linear driving chip also has a clock input terminal electrically coupled to the control module for receiving an operational clock.

In one example, the control module connects with the linear constant current circuit using a I2C connection.

In one example, the hybrid luminance circuit includes at least one illuminating unit that are electrically coupled in parallel with each other.

In one example, the at least one illuminating element illuminates a white light and at least one of a red light, a green light and a blue light.

In one example, the linear constant current circuit is respectively and electrically coupled to each of the at least one illuminating unit for controlling the at least one illuminating unit's luminance and color light based on the control signal.

In one example, the control module generates the control signal that sets a respective maximal output current for each of the at least one illuminating unit.

In one example, the at least one illuminating unit includes at least one light emitting diode (LED).

In one example, the linear constant current circuit and the hybrid luminance circuit are integrated on a same hardware.

In one example, the linear luminance adjusting circuit includes a protection component that is electrically coupled to the rectifying circuit.

In one example, the protection component includes a fuse.

In one example, the linear luminance adjusting circuit includes a filter circuit that is electrically coupled between the rectifying circuit and anyone of the constant voltage circuit, the linear constant current circuit and the hybrid luminance circuit. In addition, the filter circuit filters the rectified voltage.

In one example, the filter circuit includes a third capacitor that has a first terminal electrically coupled in between the rectifying circuit and the constant voltage circuit. Moreover, the filter circuit has a second terminal electrically coupled to ground.

DETAILED DESCRIPTION

As mentioned above, the present disclosure discloses a linear luminance adjusting circuit that applies a single-stage structure. Such that the disclosed linear luminance adjusting circuit takes a smaller space and a lower fabrication cost in comparison to those of the conventional LED illuminating circuit.

Figure 1:
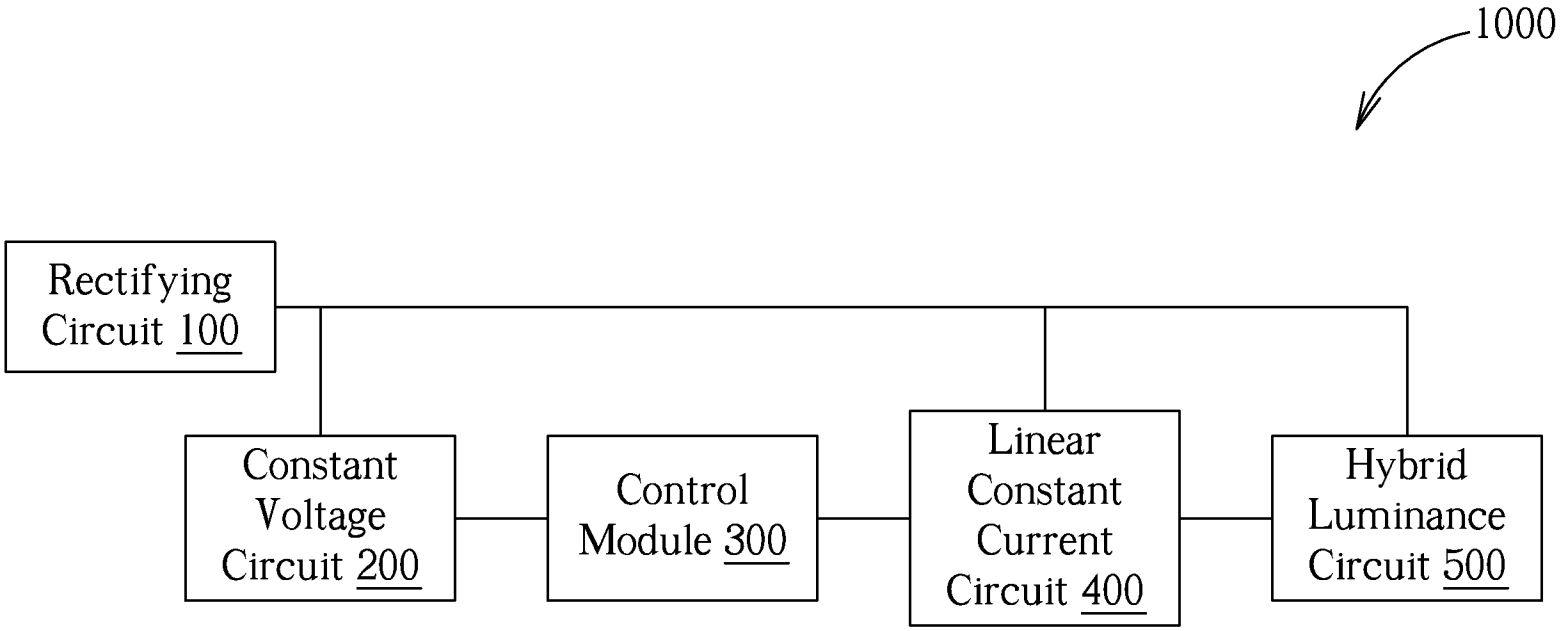
FIG. 1 illustrates a linear luminance adjusting circuit 1000 according to one embodiment of the present disclosure.

FIG. 1 illustrates a linear luminance adjusting circuit 1000 according to one embodiment of the present disclosure. The linear luminance adjusting circuit 1000 includes a rectifying circuit 100, a constant voltage circuit 200, a control module 300, a linear constant current circuit 400 and a hybrid luminance circuit 500.

The rectifying circuit 100 has a first alternative-current (AC) input terminal that is electrically coupled to a positive terminal of an AC power source (not illustrated for brevity). Also, the rectifying circuit 100 has a second AC input terminal that is electrically coupled to a negative terminal of the AC power source. In addition, the rectifying circuit 100 rectifies power from the AC power source to generated a rectified voltage.

The constant voltage circuit 200 is electrically coupled to an output terminal of the rectifying circuit 100. Besides, the constant voltage circuit 200 transforms the rectified voltage into a constant voltage.

The control module 300 is electrically coupled to the constant voltage circuit 200. And the control module 300 generates a control signal using the constant voltage.

The linear constant current circuit 400 is electrically coupled to the rectifying circuit 100 and the control module 300. Moreover, the linear constant current circuit 400 is powered up using the rectifying voltage. And the linear constant current circuit 400 generates a linear current using the control signal.

The hybrid luminance circuit 500 is electrically coupled to the rectifying circuit 100 and the linear constant current circuit 400. Also, the hybrid luminance circuit 500 illuminates using the linear current.

Specifically, since the rectifying circuit 100 is directly and electrically coupled to the linear constant current circuit 400 to form a single-stage structure, the linear luminance adjusting circuit 1000 has significantly circuitry in comparison to that of the conventional LED illuminating circuit that applies the more cost-wasting and cumbersome two-stage structure.

In some examples, the rectifying circuit 100 generates the rectified voltage in a full-bridge manner that has an entirely positive waveform, instead of in a half-bridge manner that has a positive waveform and a negative waveform respectively in half. In this way, the rectified voltage can be better transformed into a DC voltage for more efficiently driving illuminating units.

Figure 2:
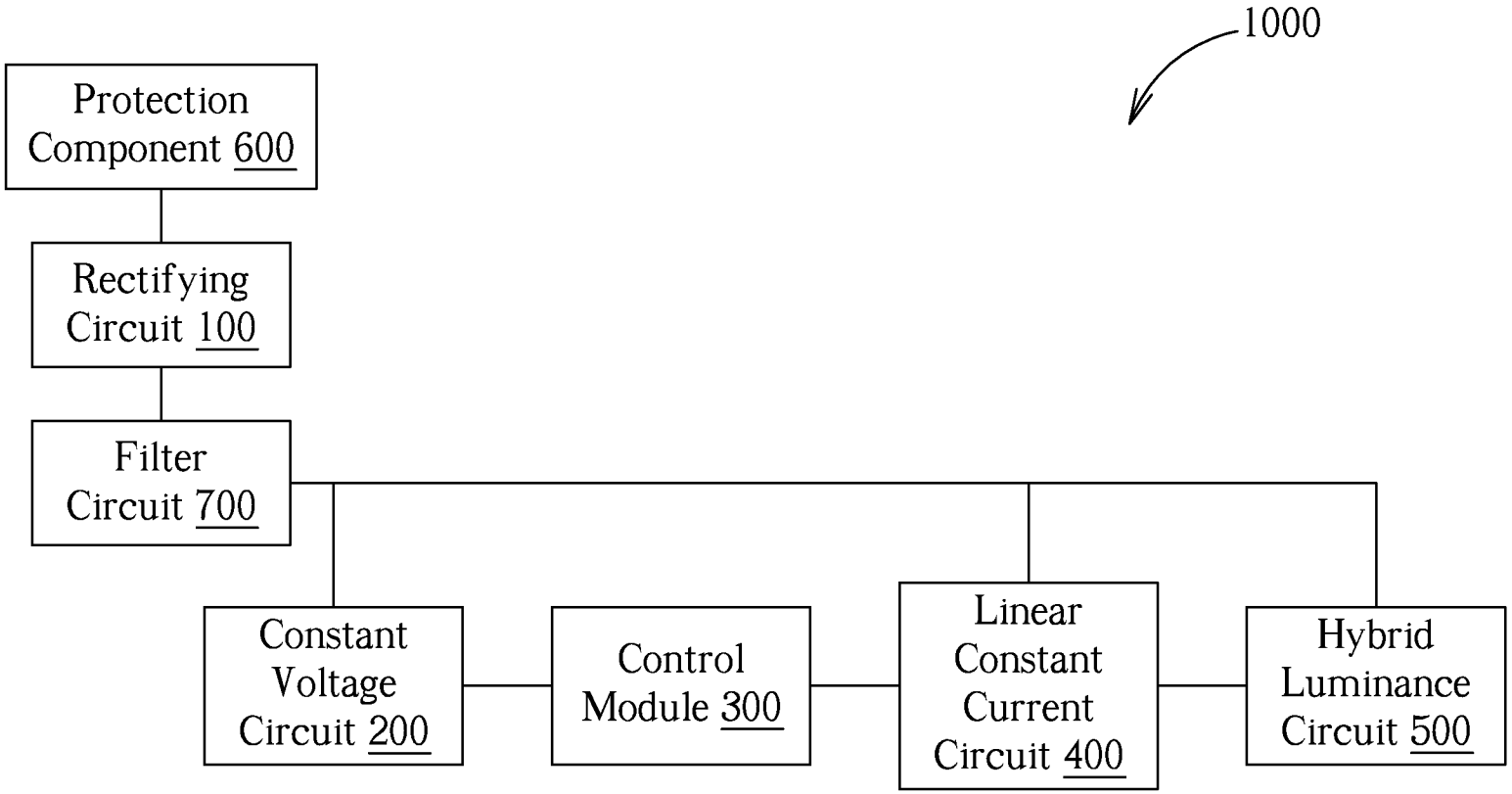
FIG. 2 illustrates another example of the disclosed linear luminance adjusting circuit shown in FIG. 1 that additionally includes a protection component and a filter circuit.

FIG. 2 illustrates another example of the disclosed linear luminance adjusting circuit 1000 shown in FIG. 1. Specifically, the linear luminance adjusting circuit 1000 may further include a protection component and a filter circuit 700.

The protection component 600 is electrically coupled to the rectifying circuit 100. In some examples, the protection component 600 is implemented using at least one fuse FR1.

The filter circuit 700 is electrically coupled between the rectifying circuit 100 and anyone of the constant voltage circuit 200, the linear constant current circuit 400 and the hybrid luminance circuit 500. In addition, the filter circuit 700 filters the rectified voltage from the rectifying circuit 100. In one example, the filter circuit 700 is implemented using a third capacitor C3. The third capacitor C3 has a first terminal electrically coupled in between the rectifying circuit 100 and the constant voltage circuit 200. Moreover, the third capacitor C3 has a second terminal electrically coupled to ground.

Figure 3:
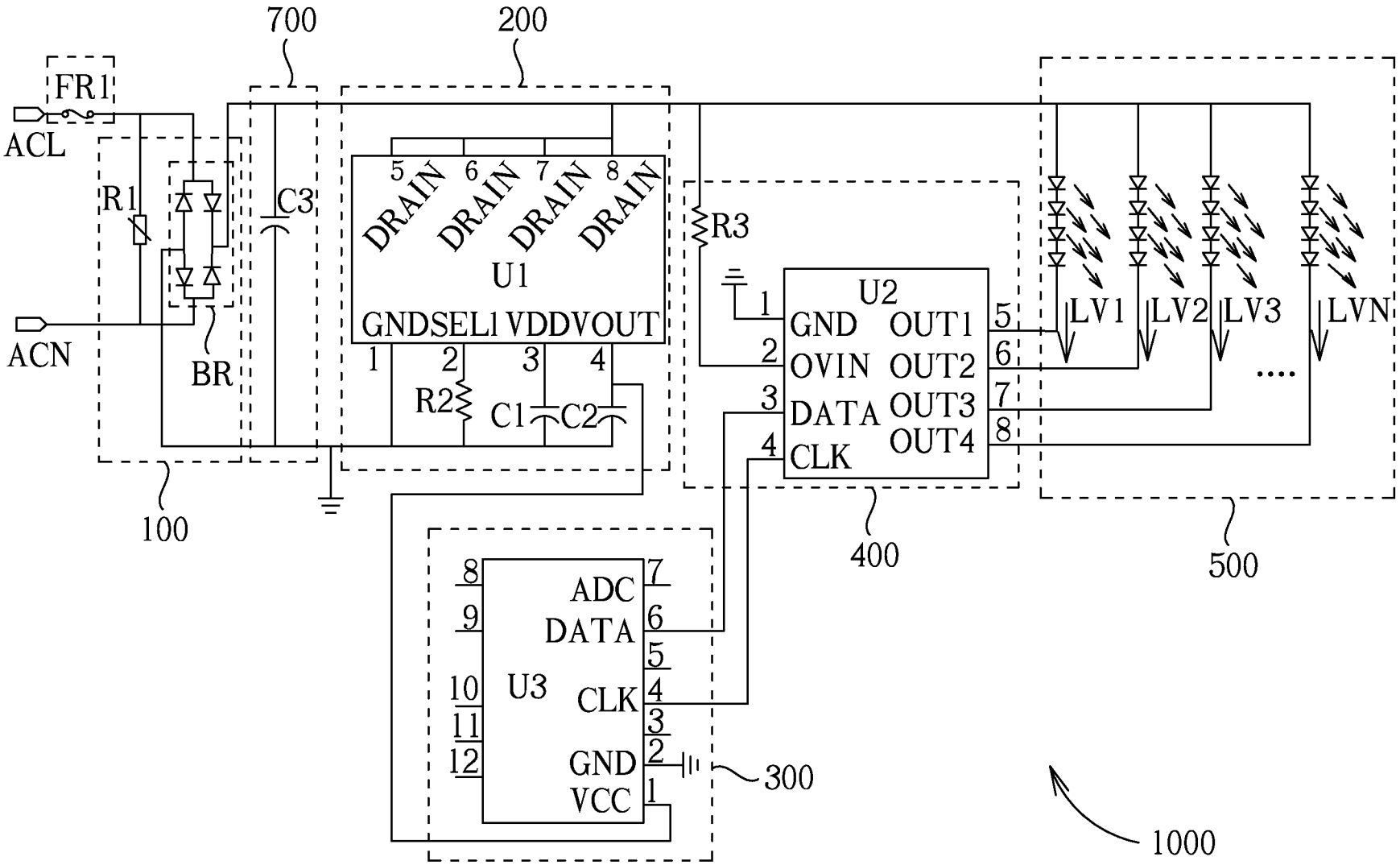
FIG. 3 illustrates a detailed diagram of the linear luminance adjusting circuit shown in FIG. 1 or FIG. 2 according to one example of the present disclosure.

FIG. 3 illustrates a detailed diagram of the linear luminance adjusting circuit 1000 shown in FIG. 1 or FIG. 2 according to one example of the present disclosure.

The rectifying circuit 100 includes a full-bridge convertor BR and a first resistor R1.

The full-bridge convertor BR is electrically coupled to the rectifying circuit 100's first AC input terminal and second AC input terminal for rectifying the power from the AC power source. The full-bridge convertor BR has a first DC output terminal electrically coupled to the constant voltage circuit. Also, the full-bridge convertor BR has a second DC output terminal electrically coupled to ground.

The first resistor R1 has a first terminal electrically coupled to the rectifying circuit 100's first AC input terminal. Besides, the first resistor R1 has a second terminal electrically coupled to the rectifying circuit 100's second AC input terminal. In one example, the first resistor R1 is implemented using a voltage-sensitive resistor or using a combination of at least one regular resistors and voltage-sensitive resistors.

In one example, the constant voltage circuit 200 includes a constant voltage power supply chip U1 that has at least one input terminal DRAIN electrically coupled to the rectifying circuit 100 for receiving the rectified voltage. Second, the constant voltage power supply chip U1 has an output terminal VOUT electrically coupled to the control module 300 for forwarding the control signal. Third, the constant voltage power supply chip U1 has a current control terminal SEL electrically coupled to ground. Fourth, the constant voltage power supply chip U1 has an operating voltage terminal VDD electrically coupled to ground. Last, the constant voltage power supply chip U1 has a ground terminal GND electrically coupled to ground. Also, the constant voltage power supply chip U1 generates the constant voltage based on a predetermined voltage outputting hardware setting. Specifically, the constant voltage power supply chip U1 can select various levels of the constant voltage for driving succeeding hardware components based on their respective requirements.

In one example, the constant voltage circuit 200 also includes a second resistor R2 that has a first terminal electrically coupled to the constant voltage power supply chip U1's current control terminal SEL. Besides, the second resistor R2 has a second terminal electrically coupled to ground.

In one example, the constant voltage circuit 200 additionally includes a first capacitor C1 that has a first terminal electrically coupled to the constant voltage power supply chip U1's operating voltage terminal VDD. Moreover, the first capacitor C1 has a second terminal electrically coupled to ground.

In one example, the constant voltage circuit 200 includes a second capacitor C2 that has a first terminal electrically coupled to the constant voltage power supply chip U1's output terminal VOUT. Besides, the second capacitor C2 has a second terminal electrically coupled to ground.

In one example, the control module 300 includes a wireless communication module for receiving remote control settings to adjust its way to generate the control signal.

In one example, the linear constant current circuit 400 includes a linear driving chip U2 that has a signal input terminal VIN electrically coupled to the rectifying circuit 100 for receiving the rectified voltage. Also, the linear constant current driving chip U2 has at least one constant current output terminal (e.g., output terminals OUT1, OUT2, OUT3 and OUT4) electrically coupled to the hybrid luminance circuit 500 for forwarding the linear current.

In one example, the linear constant current circuit 400 includes a third resistor R3 that has a first terminal electrically coupled to the rectifying circuit 100. Moreover, the third resistor R3 has a second terminal electrically coupled to the linear driving chip U2's signal input terminal VIN.

In one example, the linear driving chip U2 has a data input terminal DATA electrically coupled to the control module 300 for receiving the control signal. The linear driving chip U2 also has a clock input terminal CLK electrically coupled to the control module 300 for receiving an operational clock.

In one example, the control module 300 connects with the linear constant current circuit 400 using a I2C connection (i.e., Inter-Integrated Circuit connection). Such that the control module 300 and the linear constant current circuit 400 can synchronize respective data and operational clock in a more rapid and efficient manner.

In some other examples, the control module 300 connects with the linear constant current circuit 400 using a multiple parallel signal connection or a one-wire connection.

In one example, the hybrid luminance circuit 500 includes at least one illuminating unit LV1, LV2, LV3, . . . , and LVN that are electrically coupled in parallel with each other, where N is a positive integer.

In one example, the at least one illuminating element LV1, LV2, LV3, . . . , and LVN illuminates a white light and at least one of a red light, a green light and a blue light. Such that the hybrid luminance circuit 500 may illuminate various combinations of colors under the control module 300's control.

In one example, the linear constant current circuit 400 is respectively and electrically coupled to each of the at least one illuminating unit LV1, LV2, LV3, . . . , and LVN for more precisely controlling the at least one illuminating unit LV1, LV2, LV3, . . . , and LVN's luminance and color light based on the control signal.

In one example, the control module 300 generates the control signal that sets a respective maximal output current for each of the at least one illuminating unit LV1, LV2, LV3, . . . , and LVN.

In one example, the at least one illuminating unit LV1, LV2, LV3, . . . , and LVN is implemented using at least one light emitting diode.

In one example, the linear constant current circuit 400 and the hybrid luminance circuit 500 are integrated on a same hardware. Such that the linear luminance adjusting circuit 100's fabrication cost and volume can be additionally reduced. Besides, such disposition can reach a more stable output power and reduce control malfunction between the linear constant current circuit 400 and the hybrid luminance circuit 500.

In summary, the present disclosure provides a linear luminance adjusting circuit capable of adjusting its luminance and/or color of light by respectively adjusting its hybrid illuminance circuit's illuminating elements. On top of that, the disclosed linear luminance adjusting circuit applies a one-stage structure that integrates its rectifying circuit and linear constant-current circuit, instead of applying a two-stage structure that renders the conventional LED illuminating circuit to be more cumbersome and cost-wasting. In this way, the disclosed one-stage linear luminance adjusting circuit substantially prevails the conventional LED adjusting circuit in a significantly smaller volume and a more cost-effective manner.

The invention claimed is:

1. A linear luminance adjusting circuit, comprising:

a rectifying circuit, having a first alternative-current (AC) input terminal electrically coupled to a positive terminal of an AC power source, a second AC input terminal electrically coupled to a negative terminal of the AC power source, and the rectifying circuit is configured to rectify power from the AC power source to generated a rectified voltage;

a constant voltage circuit, electrically coupled to an output terminal of the rectifying circuit, and configured to transform the rectified voltage into a constant voltage;

a control module, electrically coupled to the constant voltage circuit, and configured to generate a control signal using the constant voltage;

a linear constant current circuit, electrically coupled to the rectifying circuit and the control module, configured to be powered up using the rectifying voltage, and configured to generate a linear current using the control signal; and a hybrid luminance circuit, electrically coupled to the rectifying circuit and the linear constant current circuit, and configured to illuminate using the linear current, wherein the constant voltage circuit comprises:

a constant voltage power supply chip, having an input terminal electrically coupled to the rectifying circuit for receiving the rectified voltage, having an output terminal electrically coupled to the control module for forwarding the control signal, having a current control terminal electrically coupled to ground, having an operating voltage terminal electrically coupled to ground, and having a ground terminal electrically coupled to ground;

wherein the constant voltage power supply chip is configured to generate the constant voltage based on a predetermined voltage outputting hardware setting.

2. The linear luminance adjusting circuit of claim 1, wherein the rectifying circuit further comprises:

a full-bridge convertor, electrically coupled to the rectifying circuit's first AC input terminal and second AC input terminal for rectifying the power from the AC power source, wherein the full-bridge convertor has a first direct-current (DC) output terminal electrically coupled to the constant voltage circuit, and has a second DC output terminal electrically coupled to ground; and a first resistor, having a first terminal electrically coupled to the rectifying circuit's first AC input terminal, and having a second terminal electrically coupled to the rectifying circuit's second AC input terminal.

3. The linear luminance adjusting circuit of claim 2, wherein the first resistor comprises a voltage-sensitive resistor.

4. The linear luminance adjusting circuit of claim 1, wherein the constant voltage circuit further comprises:

a second resistor, having a first terminal electrically coupled to the constant voltage power supply chip's current control terminal, and having a second terminal electrically coupled to ground.

5. The linear luminance adjusting circuit of claim 1, the constant voltage circuit further comprises:

a first capacitor, having a first terminal electrically coupled to the constant voltage power supply chip's operating voltage terminal, and having a second terminal electrically coupled to ground.

6. The linear luminance adjusting circuit of claim 1, the constant voltage circuit further comprises:

a second capacitor, having a first terminal electrically coupled to the constant voltage power supply chip's output terminal, and having a second terminal electrically coupled to ground.

7. The linear luminance adjusting circuit of claim 1, wherein the control module comprises a wireless communication module.

8. The linear luminance adjusting circuit of claim 1, wherein the linear constant current circuit comprises:

a linear driving chip, having a signal input terminal electrically coupled to the rectifying circuit for receiving the rectified voltage, and having a constant current output terminal electrically coupled to the hybrid luminance circuit for forwarding the linear current.

9. The linear luminance adjusting circuit of claim 8, wherein the linear constant current circuit further comprises:

a third resistor, having a first terminal electrically coupled to the rectifying circuit, and having a second terminal electrically coupled to the linear driving chip's signal input terminal.

10. The linear luminance adjusting circuit of claim 8, wherein the linear driving chip has a data input terminal electrically coupled to the control module for receiving the control signal, and has a clock input terminal electrically coupled to the control module for receiving an operational clock.

11. The linear luminance adjusting circuit of claim 1, wherein the control module is further configured to connect with the linear constant current circuit using an Inter-Integrated Circuit (I2C) connection, a multiple parallel signal connection, or a one-wire connection.

12. The linear luminance adjusting circuit of claim 1, wherein the hybrid luminance circuit comprises at least one illuminating unit that are electrically coupled in parallel with each other.

13. The linear luminance adjusting circuit of claim 12, wherein the at least one illuminating element is further configured to illuminate a white light and at least one of a red light, a green light and a blue light.

14. The linear luminance adjusting circuit of claim 12, wherein the linear constant current circuit is further configured to be respectively and electrically coupled to each of the at least one illuminating unit for controlling the at least one illuminating unit's luminance and color light based on the control signal.

15. The linear luminance adjusting circuit of claim 14, wherein the control module is further configured to generate the control signal that sets a respective maximal output current for each of the at least one illuminating unit.

16. The linear luminance adjusting circuit of claim 12, wherein the at least one illuminating unit comprises at least one light emitting diode (LED).

17. The linear luminance adjusting circuit of claim 1, wherein the linear constant current circuit and the hybrid luminance circuit are integrated on a same hardware.

18. The linear luminance adjusting circuit of claim 1, further comprising:

a protection component, electrically coupled to the rectifying circuit.

19. The linear luminance adjusting circuit of claim 18, wherein the protection component comprises a fuse.

* * * * *